US008567199B2

(12) United States Patent
Barton et al.

(10) Patent No.: US 8,567,199 B2
(45) Date of Patent: Oct. 29, 2013

(54) METHOD AND APPARATUS OF INTRODUCING DILUENT FLOW INTO A COMBUSTOR

(75) Inventors: Jesse Ellis Barton, Simpsonville, SC (US); Jonathan Dwight Berry, Simpsonville, SC (US); Mark Allan Hadley, Greer, SC (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 597 days.

(21) Appl. No.: 12/250,995

(22) Filed: Oct. 14, 2008

(65) Prior Publication Data

US 2010/0089021 A1 Apr. 15, 2010

(51) Int. Cl.
*F02C 3/20* (2006.01)

(52) U.S. Cl.
USPC ..... 60/772; 60/775; 60/740; 60/39.55; 431/162; 431/163; 239/419.3; 239/427.5

(58) Field of Classification Search
USPC ..... 60/39.53, 742, 747, 775, 804, 39.55, 60/39.58, 723, 748, 772, 799, 800, 737, 60/738, 740, 743, 746, 39.094; 431/12, 431/162, 163, 181, 187, 188, 189, 190; 239/86, 398, 400, 418, 419, 419.3, 239/422, 426, 427.3, 427.5, 428, 429, 430, 239/433, 434.5
See application file for complete search history.

(56) References Cited

U.S. PATENT DOCUMENTS

| | | | | | |
|---|---|---|---|---|---|
| 1,781,236 | A | * | 11/1930 | Lilge | 431/352 |
| 2,812,978 | A | | 11/1957 | Billman | |
| 3,704,762 | A | | 12/1972 | Smith et al. | |
| 3,724,229 | A | | 4/1973 | Seliber | |
| 3,735,930 | A | * | 5/1973 | Mori | 239/419.5 |
| 3,747,336 | A | | 7/1973 | Dibelius et al. | |
| 3,869,246 | A | * | 3/1975 | Hammond et al. | 431/351 |
| 4,085,708 | A | | 4/1978 | Ashdown | |
| 4,322,945 | A | | 4/1982 | Peterson et al. | |
| 4,365,753 | A | | 12/1982 | Harding et al. | |
| 4,421,989 | A | | 12/1983 | Brannstrom | |

(Continued)

FOREIGN PATENT DOCUMENTS

| | | |
|---|---|---|
| JP | 09152105 | 6/1997 |
| JP | 2007064227 A | 3/2007 |
| JP | 2008089297 | 4/2008 |
| WO | WO2008047825 | 4/2008 |

OTHER PUBLICATIONS

Office Action from CN Application No. 200910174089.2 dated Mar. 20, 2013.

*Primary Examiner* — Ted Kim
*Assistant Examiner* — Michael B Mantyla
(74) *Attorney, Agent, or Firm* — Cantor Colburn LLP

(57) ABSTRACT

Disclosed is a combustor including a baffle plate having at least one through baffle hole and at least one fuel nozzle extending through the at least one baffle hole. A plurality of injection holes extend through the at least one fuel nozzle and are configured to meter a flow of diluent into the combustor. Further disclosed is a method for providing diluent to a combustor including providing a plurality of openings located at at least one fuel nozzle extending through a through hole in a baffle plate. The diluent is flowed through the plurality of openings toward at least one airflow opening in the at least one fuel nozzle.

10 Claims, 10 Drawing Sheets

(56) References Cited

U.S. PATENT DOCUMENTS

| | | | | | |
|---|---|---|---|---|---|
| 4,600,151 | A | | 7/1986 | Bradley | |
| 4,893,468 | A | | 1/1990 | Hines | |
| 4,928,478 | A | | 5/1990 | Maslak | |
| 4,948,055 | A | | 8/1990 | Belcher et al. | |
| 5,054,279 | A | | 10/1991 | Hines | |
| 5,058,374 | A | | 10/1991 | Bechlher et al. | |
| 5,247,790 | A | * | 9/1993 | Donlan et al. | 60/800 |
| 5,271,216 | A | | 12/1993 | Frutschi et al. | |
| 5,271,218 | A | | 12/1993 | Taylor | |
| 5,284,438 | A | | 2/1994 | McGill et al. | |
| 5,285,632 | A | | 2/1994 | Halila | |
| 5,329,758 | A | | 7/1994 | Urbach et al. | |
| 5,331,806 | A | | 7/1994 | Warkentin | |
| 5,357,745 | A | | 10/1994 | Probert | |
| 5,361,578 | A | | 11/1994 | Donlan | |
| 5,375,409 | A | | 12/1994 | Lamar | |
| 5,457,721 | A | | 10/1995 | Tsiklauri et al. | |
| 5,526,386 | A | | 6/1996 | Tsiklauri et al. | |
| 5,540,056 | A | * | 7/1996 | Heberling et al. | 60/737 |
| 5,581,999 | A | | 12/1996 | Johnson | |
| 5,623,827 | A | | 4/1997 | Monty | |
| 5,634,329 | A | | 6/1997 | Andersson et al. | |
| 5,784,875 | A | * | 7/1998 | Statler | 60/775 |
| 5,793,831 | A | | 8/1998 | Tsiklauri et al. | |
| 5,794,449 | A | | 8/1998 | Razdan et al. | |
| 5,813,232 | A | | 9/1998 | Razdan et al. | |
| 5,829,682 | A | * | 11/1998 | Haruch | 239/419 |
| 5,861,600 | A | | 1/1999 | Jensen | |
| 5,867,977 | A | | 2/1999 | Zachary et al. | |
| 5,873,234 | A | | 2/1999 | Bruckner et al. | |
| 5,894,732 | A | | 4/1999 | Kwan | |
| 5,930,990 | A | | 8/1999 | Zachary et al. | |
| 5,946,917 | A | | 9/1999 | Hums et al. | |
| 5,956,955 | A | | 9/1999 | Schmid | |
| 6,003,299 | A | | 12/1999 | Idleman | |
| 6,035,645 | A | | 3/2000 | Bensaadi et al. | |
| 6,047,539 | A | | 4/2000 | Farmer | |
| 6,089,024 | A | | 7/2000 | Hatanaka | |
| 6,094,916 | A | | 8/2000 | Puri et al. | |
| 6,189,310 | B1 | | 2/2001 | Kalitventzeff et al. | |
| 6,192,688 | B1 | | 2/2001 | Beebe | |
| 6,267,585 | B1 | | 7/2001 | Suttrop | |
| 6,286,300 | B1 | * | 9/2001 | Zelina et al. | 60/804 |
| 6,293,088 | B1 | | 9/2001 | Moore et al. | |
| 6,298,667 | B1 | | 10/2001 | Glynn et al. | |
| 6,334,309 | B1 | * | 1/2002 | Dean et al. | 60/737 |
| 6,360,776 | B1 | | 3/2002 | McCormick et al. | |
| 6,370,862 | B1 | | 4/2002 | Cheng | |
| 6,389,800 | B2 | | 5/2002 | Badeer | |
| 6,393,823 | B1 | | 5/2002 | Badeer | |
| 6,405,521 | B1 | | 6/2002 | Ranasinghe et al. | |
| 6,422,022 | B2 | | 7/2002 | Gorman et al. | |
| 6,434,945 | B1 | | 8/2002 | Mandai et al. | |
| 6,497,105 | B1 | | 12/2002 | Stastny | |
| 6,499,303 | B1 | | 12/2002 | Polukort et al. | |
| 6,526,758 | B2 | | 3/2003 | Ranasinghe et al. | |
| 6,530,224 | B1 | | 3/2003 | Conchieri | |
| 6,609,380 | B2 | | 8/2003 | Mick et al. | |
| 6,748,733 | B2 | | 6/2004 | Tamaro | |
| 6,782,703 | B2 | | 8/2004 | Dovali-Solis | |
| 6,928,821 | B2 | | 8/2005 | Gerhold | |
| 6,983,605 | B1 | | 1/2006 | Hook et al. | |
| 7,000,396 | B1 | | 2/2006 | Storey | |
| 7,104,069 | B2 | | 9/2006 | Martling et al. | |
| 7,104,070 | B2 | | 9/2006 | Iasillo et al. | |
| 7,140,189 | B2 | | 11/2006 | Markarian et al. | |
| 7,143,583 | B2 | * | 12/2006 | Hayashi et al. | 60/776 |
| 7,185,497 | B2 | * | 3/2007 | Dudebout et al. | 60/776 |
| 7,228,682 | B2 | | 6/2007 | Kashler | |
| 7,395,670 | B1 | | 7/2008 | Drnevich et al. | |
| 7,681,398 | B2 | | 3/2010 | Patel et al. | |
| 7,926,281 | B2 | | 4/2011 | Commaret et al. | |
| 8,276,388 | B2 | * | 10/2012 | Cayre et al. | 60/748 |
| 2006/0059915 | A1 | | 3/2006 | Furletov et al. | |
| 2007/0003897 | A1 | * | 1/2007 | Koizumi et al. | 431/354 |
| 2007/0044477 | A1 | * | 3/2007 | Held et al. | 60/776 |
| 2007/0113556 | A1 | | 5/2007 | Biebel et al. | |
| 2007/0151255 | A1 | | 7/2007 | Johnson et al. | |
| 2007/0227147 | A1 | | 10/2007 | Cayre et al. | |
| 2007/0234735 | A1 | | 10/2007 | Mosbacher et al. | |
| 2009/0013968 | A1 | * | 1/2009 | Keegan et al. | 123/470 |

* cited by examiner

METHOD AND APPARATUS OF INTRODUCING DILUENT FLOW INTO A COMBUSTOR

BACKGROUND OF THE INVENTION

The subject invention relates generally to combustors. More particularly, the subject invention relates to the introduction of diluent flow into a combustor via a fuel nozzle.

Combustors typically include one or more fuel nozzles that introduce a fuel or a mixture of fuel and air to a combustion chamber where it is ignited. In some combustors, the fuel nozzles extend through holes disposed in a baffle plate of the combustor. In these combustors, it is often advantageous to introduce a volume of diluent, often nitrogen or steam, to the combustor to reduce $NO_x$ emissions and/or augment output of the combustor. The diluent is urged from a chamber through a gap between the baffle plate and each fuel nozzle, and then flows along a periphery of the fuel nozzle where a portion of the diluent enters the fuel nozzle via holes in the air collar of the fuel nozzle. The gaps between the baffle plate and the fuel nozzles, however, vary due to assembly tolerance stack-ups between the baffle plate and the fuel nozzles. The gap variation results in variation in diluent flow around each nozzle and throughout the combustor assembly. Further, an axial distance between the gap and the air collar holes in the fuel nozzle allow diluent to reach the combustion reaction zone without passing through the fuel nozzle and mixing directly with the fuel and air. Both of these effects reduce diluent efficiency and therefore a greater volume of diluent is required to achieve an equivalent amount of diluent flow into the fuel nozzle. The excess diluent that flows toward the combustion reaction zone without passing through the fuel nozzle leads to operability problems in the combustor such as dynamics and blow out.

BRIEF DESCRIPTION OF THE INVENTION

According to one aspect of the invention, a combustor includes a baffle plate having at least one through baffle hole and at least one fuel nozzle extending through the at least one baffle hole. A plurality of injection holes extend through the at least one fuel nozzle and are configured to meter a flow of diluent into the combustor.

According to another aspect of the invention, a method for providing diluent to a combustor includes providing a plurality of openings located at at least one fuel nozzle extending through a through hole in a baffle plate. The diluent is flowed through the plurality of openings toward at least one airflow opening in the at least one fuel nozzle.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
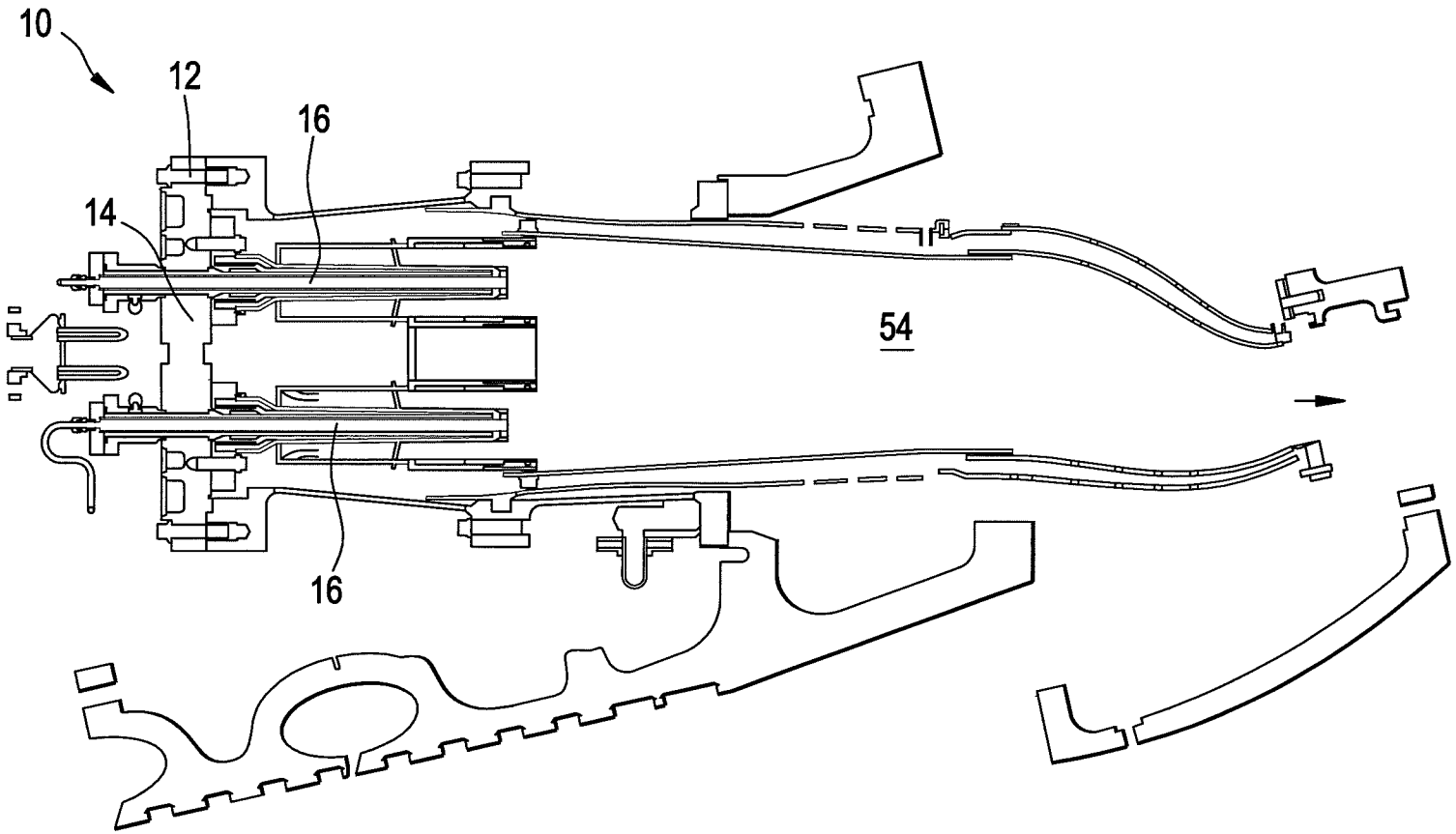
FIG. 1 is a cross-sectional view of an embodiment of a combustor.
Figure 2:
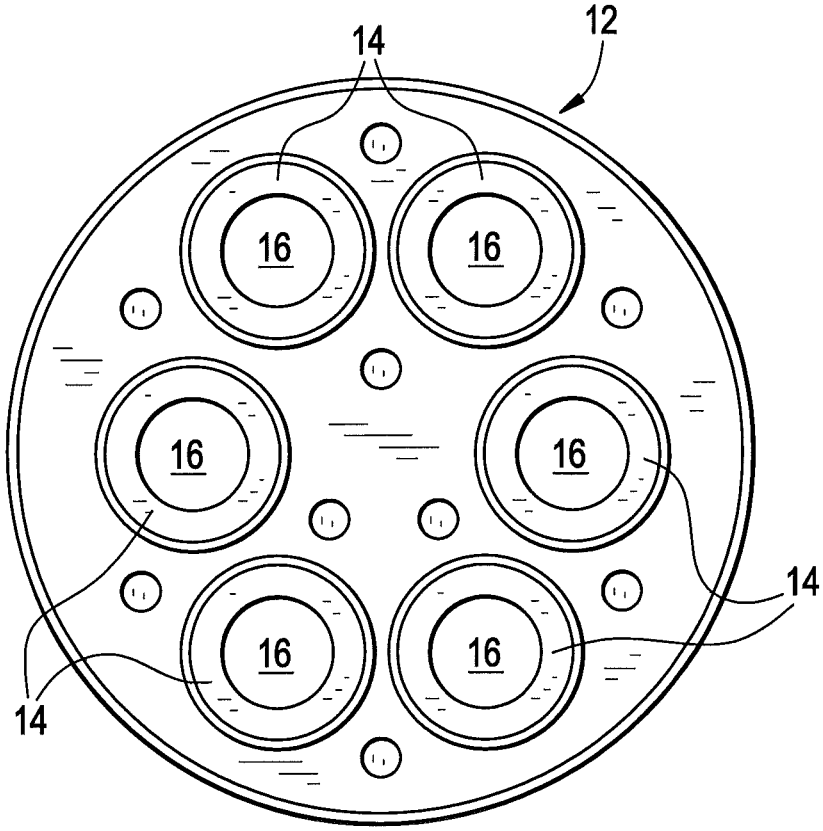
FIG. 2 is an end view of an embodiment of a baffle plate assembly of a combustor.
Figure 3:
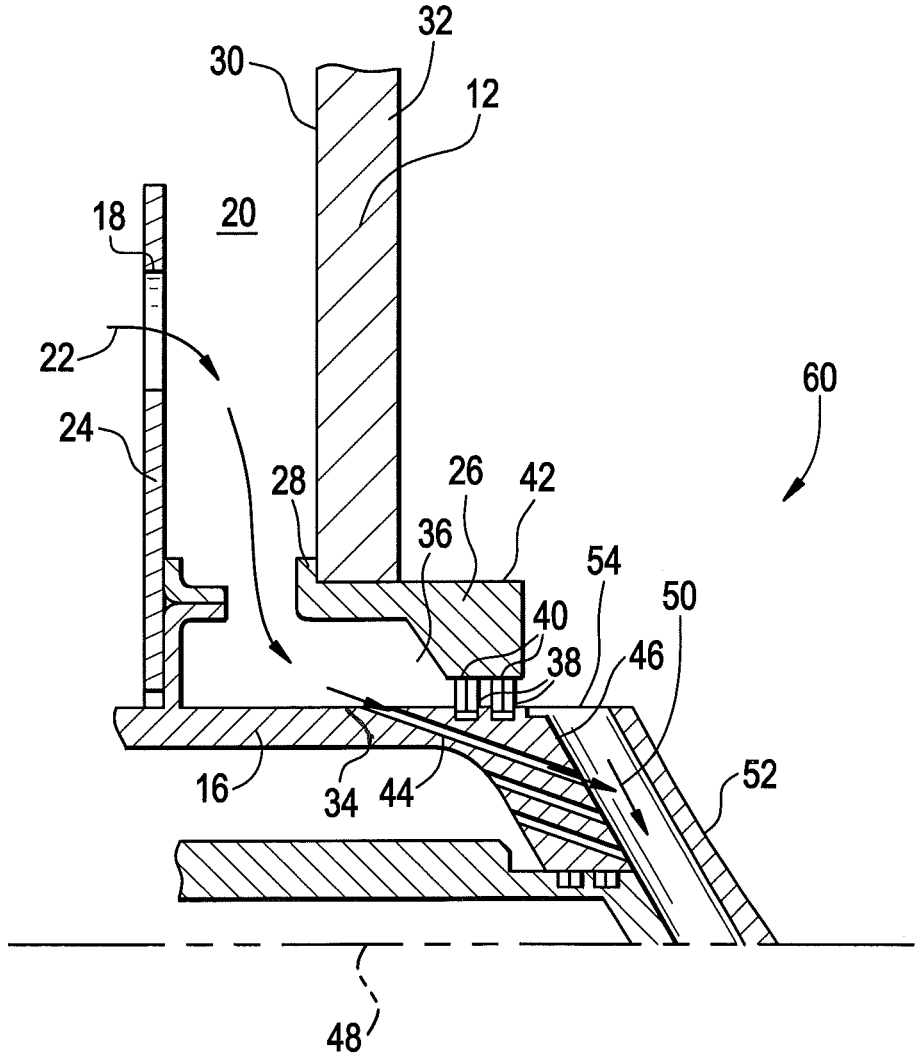
FIG. 3 is a partial cross-sectional view of an embodiment of the baffle plate assembly of FIG. 2.
Figure 4:
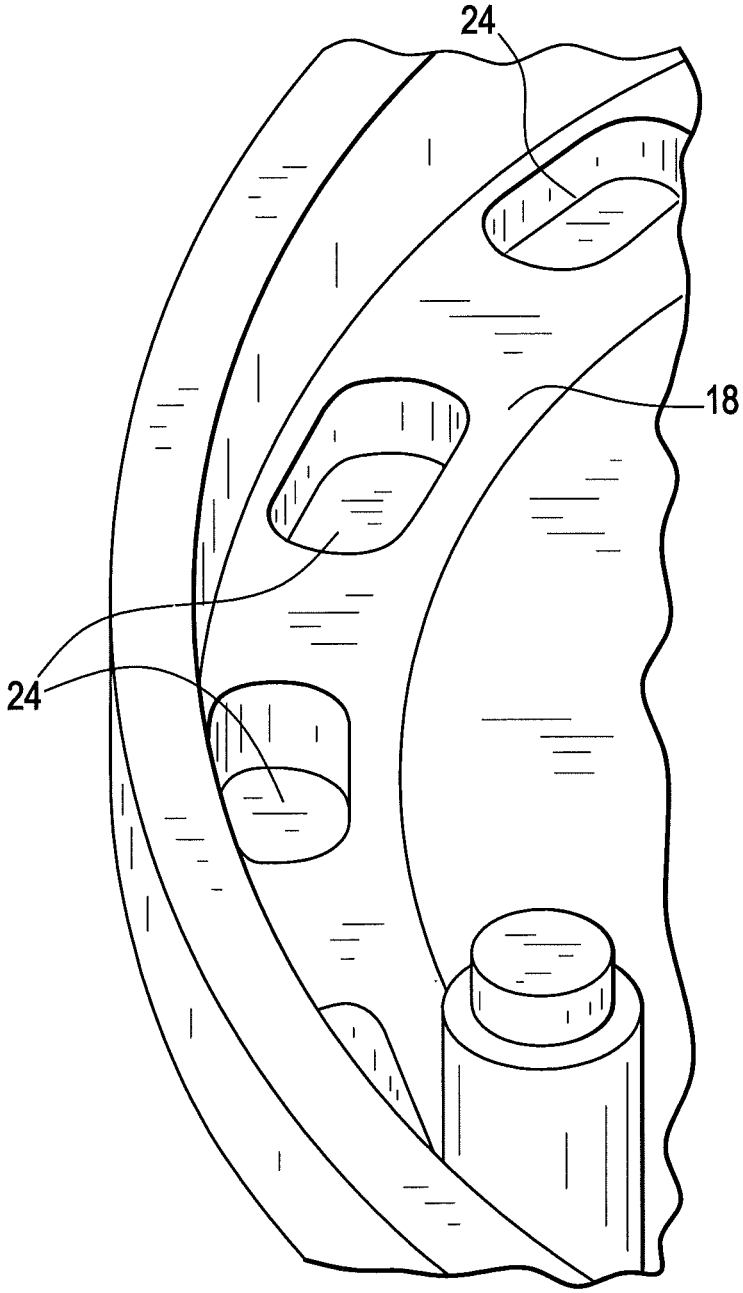
FIG. 4 is a partial perspective view of a cover ring that supplies diluent to a plenum defined by the baffle plate assembly of FIG. 2.

Shown in FIG. 1 is a combustor 10. The combustor 10 includes a baffle plate 12 having six baffle holes 14, through which six fuel nozzles 16 extend, for example, one fuel nozzle 16 extending through each baffle hole 14, as best shown in FIG. 2. While six fuel nozzles 16 are shown in FIG. 1, it is to be appreciated that other quantities of fuel nozzles 16, for example, one or four fuel nozzles 16, may be utilized. As shown in FIG. 3, the baffle plate 12 and a cover ring 18 define a plenum 20 into which a diluent flow 22 is guided via an array of orifices 24 (best shown in FIG. 4) in the cover ring 18. In some embodiments, the diluent flow 22 may comprise steam, or other diluents such as nitrogen.

At each fuel nozzle 16, as shown in FIG. 3, a shroud 26 is disposed at the baffle hole 14 between the baffle plate 12 and the fuel nozzle 16. In the embodiment of FIG. 3, the shroud 26 includes an attachment flange 28 disposed at, for example, an upstream face 30 of the baffle plate 12. In some embodiments, the attachment flange 28 is secured to the upstream face 30 by welding, but other means may be use such as mechanical fasteners, brazing, or adhesives. Further, it is to be appreciated that the shroud 26 may be secured to other portions of the baffle plate 12, for example a downstream face 32. The shroud 26 and an outer surface 34 of the fuel nozzle 16 define a flow channel 36 therebetween. Two piston rings 38 are disposed at the shroud 26 to seal between the shroud 26 and the fuel nozzle 16. As shown in FIG. 3, each piston ring 38 is disposed in a piston ring slot 40 at a tip end 42 of the shroud 26. It will be appreciated that while two piston rings 38 and two piston ring slots 40 are shown in FIG. 3, other quantities of piston rings 38 per piston ring slot 40 and quantities of piston ring slots 40, for example two or three piston rings 38 per piston ring slot 40 or one or three piston ring slots 40 may be utilized. A plurality of injection holes 44 extend, in the embodiment of FIG. 3, through the fuel nozzle 16 from the flow channel 36 to a nozzle end 46, and may be directed at an angle to a nozzle central axis 48. In operation, the diluent flow 22 is guided from the plenum 20, along the flow channel 36 and through the plurality of injection holes 44. Upon entering the nozzle end 46, the diluent flow 22 is, in some embodiments, mixed with an airflow 50 entering a nozzle air collar 52 via a plurality of airflow openings 54. Sealing between the shroud 26 and the outer surface 34 via the two piston rings 38, and injecting the diluent flow 22 via the plurality of injection holes 44 increases a proportion of the diluent flow 22 that is mixed with the airflow 50 and enters a head end (not shown) of the combustor 10 via the fuel nozzle 16.

Figure 5:
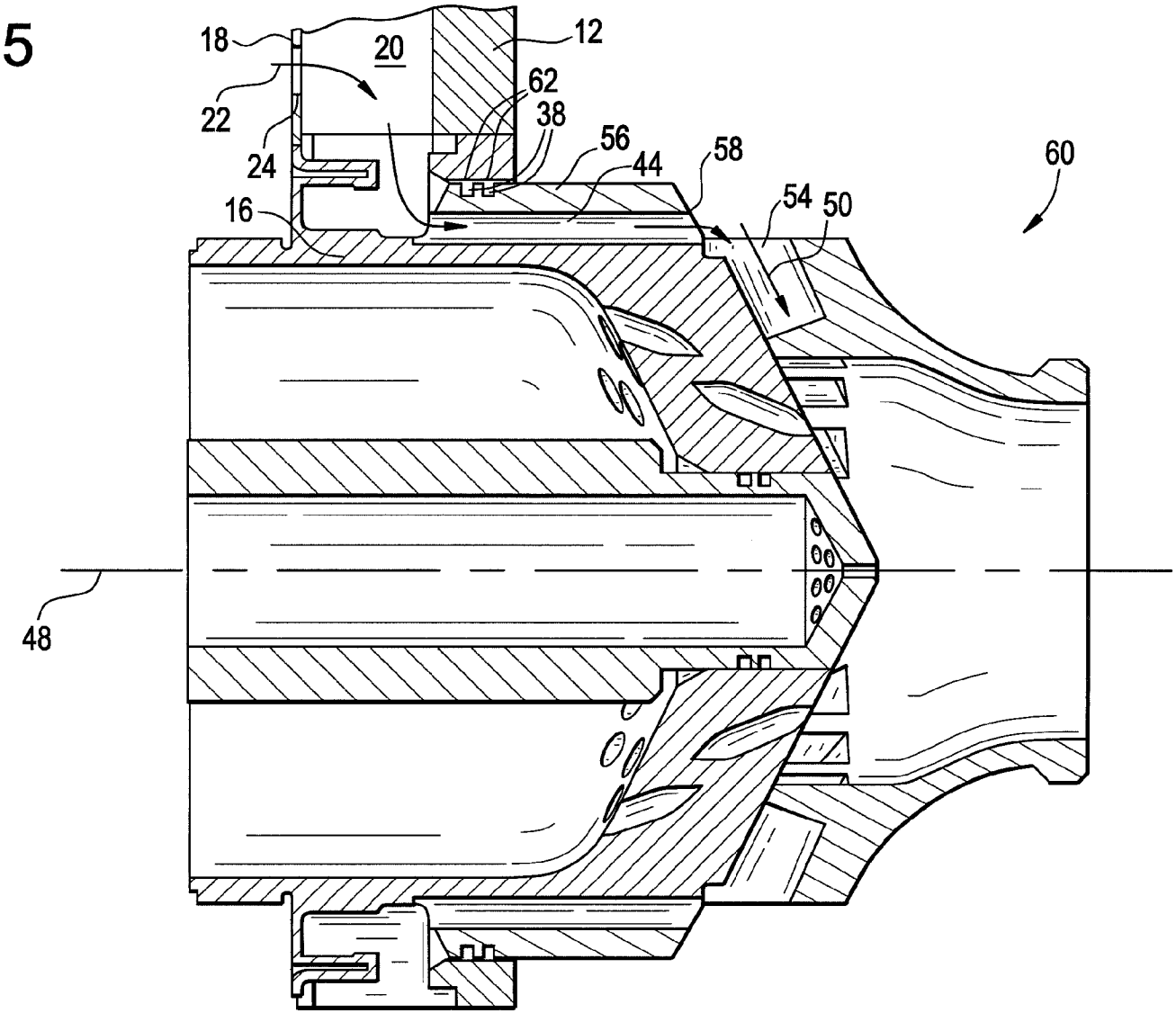
FIG. 5 is a cross-sectional view of another embodiment of the baffle plate assembly of FIG. 2.
Figure 6:
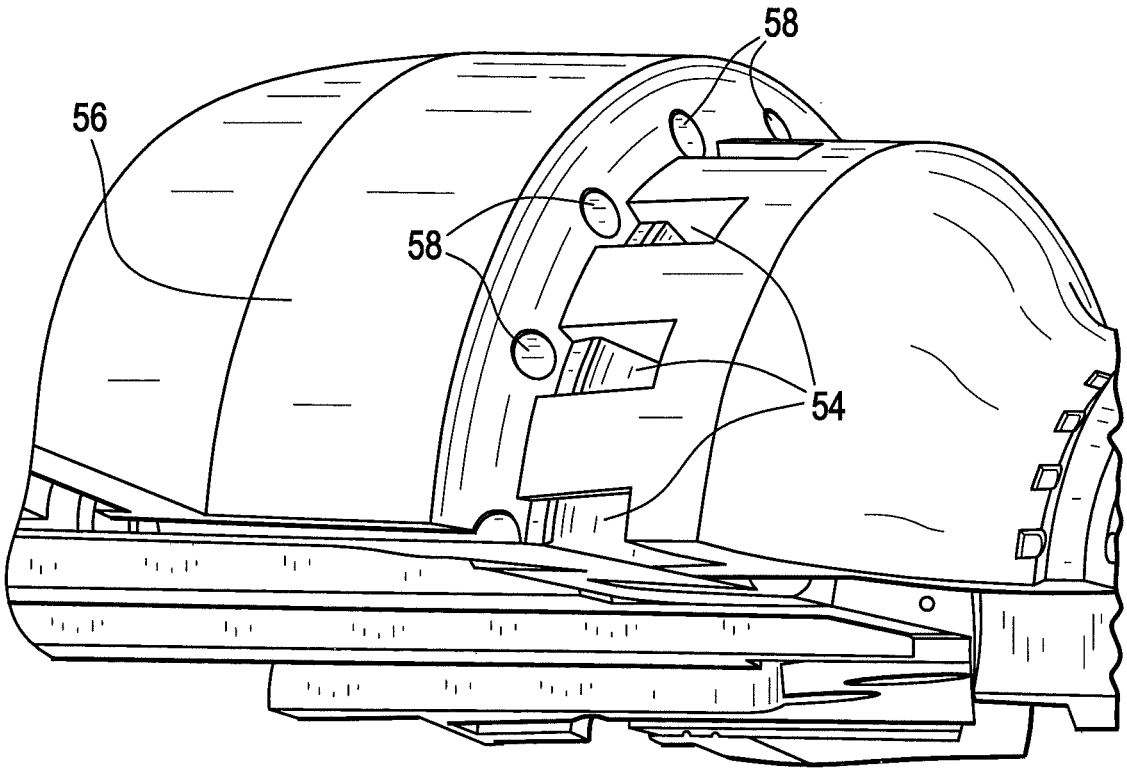
FIG. 6 is a perspective view of the baffle plate assembly of FIG. 5.

In another embodiment, as shown in FIG. 5, the plurality of injection holes 44 extend through the fuel nozzle 16 substantially parallel to the central axis 48. The plurality of injection holes 44 extends from the plenum 20 through, for example, a raised injection surface 56 which is integral to the fuel nozzle 16. As shown in FIG. 6, an exit 58 of each injection hole 44 substantially aligns with an airflow opening 54 in a circumferential direction. Referring again to FIG. 5, the diluent flow 22 passes flows from the plenum 20, through the plurality of injection holes 44 to an exterior 60 of the baffle plate 12 at the head end of the combustor 10, near the plurality of airflow openings 54. At least a portion of the diluent flow 22 enters the plurality of airflow openings 54 where it is mixed with the airflow 50. Configuring the plurality of airflow openings 44 as shown in FIG. 5 is advantageous since the exit 58 of each injection hole 44 aligns circumferentially with an airflow opening 54, thereby increasing an amount of diluent flow 22 that enters the plurality of airflow openings 54, mixes with the airflow 50 and enters the combustor via the fuel nozzle 16. Further, as shown in FIG. 5, sealing between the fuel nozzle 16 and the baffle plate 12 may be achieved via piston rings 38 disposed therebetween, without utilizing the shroud 26 of FIG. 3. The piston rings 38 of FIG. 5 are disposed in corresponding piston ring slots 62 in the fuel nozzle 16 and are compressed by the baffle plate 12. The piston rings, however, may also be disposed in piston ring slots 62 in the baffle plate 12 and compressed by the fuel nozzle 16.

Figure 7:
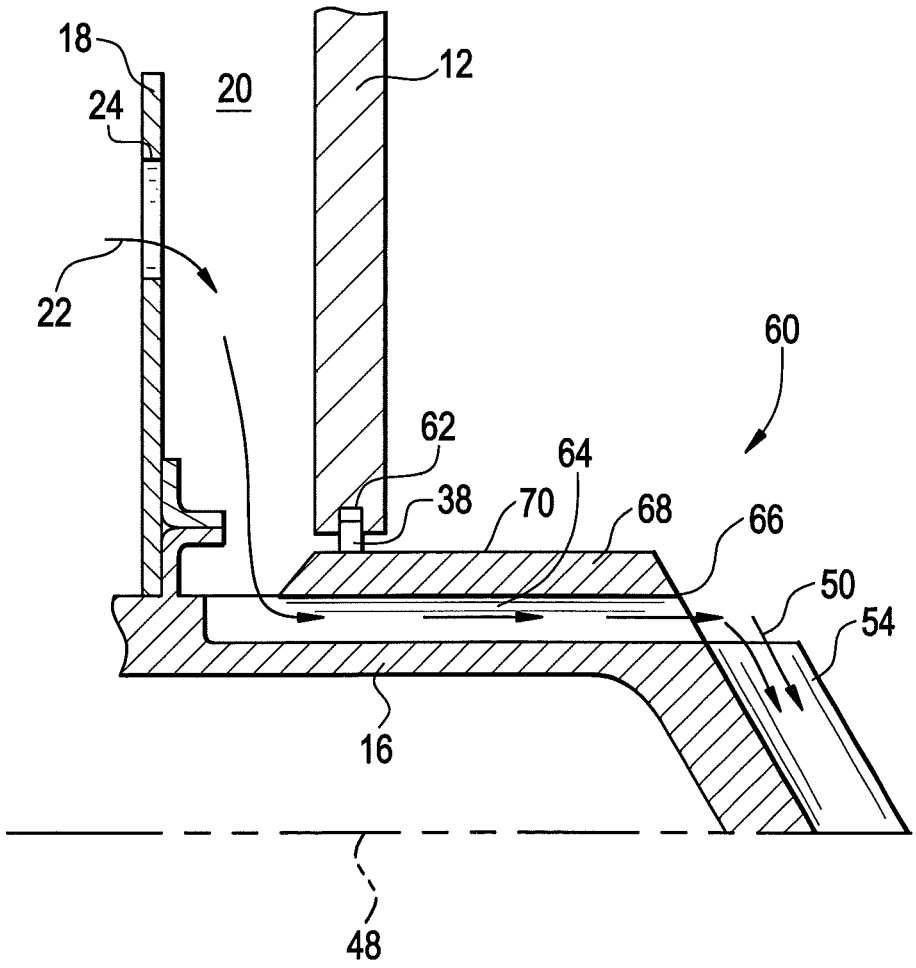
FIG. 7 is a cross-sectional view of yet another embodiment of the baffle plate assembly of FIG. 2.
Figure 8:
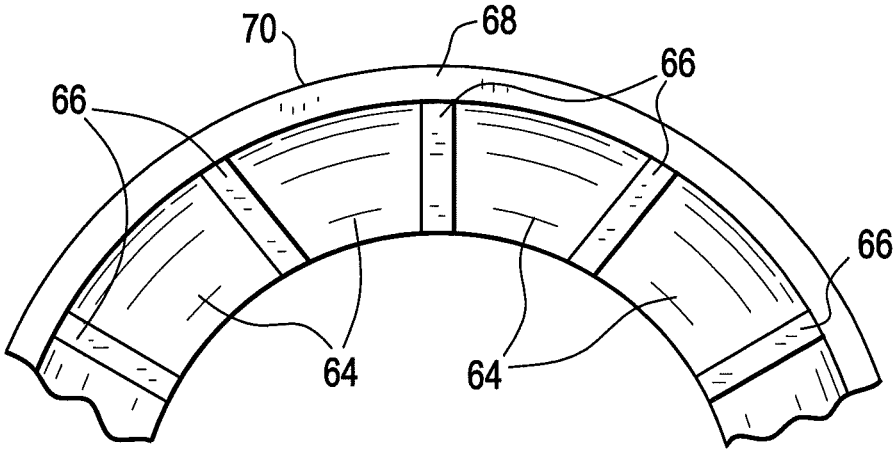
FIG. 8 is an end view of an embodiment of injection openings in the fuel nozzle shown in the baffle plate assembly of FIG. 7.

Referring now to FIG. 7, in some embodiments, the plurality of injection holes 44 comprises a plurality of injection channels 64, with a plurality of ribs 66 (shown in FIG. 8) therebetween, in the fuel nozzle 16. A sheath 68, which may be substantially annular, is secured to the ribs 66 thus defining, together with the plurality of injection channels 64, the plurality of injection holes 44. The sheath 68 may be secured by brazing, or other means such as welding, adhesives, or mechanical fasteners. In this embodiment, the piston rings 38 seal between the baffle plate 12 and the sheath 68 at an outer surface 70 of the sheath 68.

Figure 9:
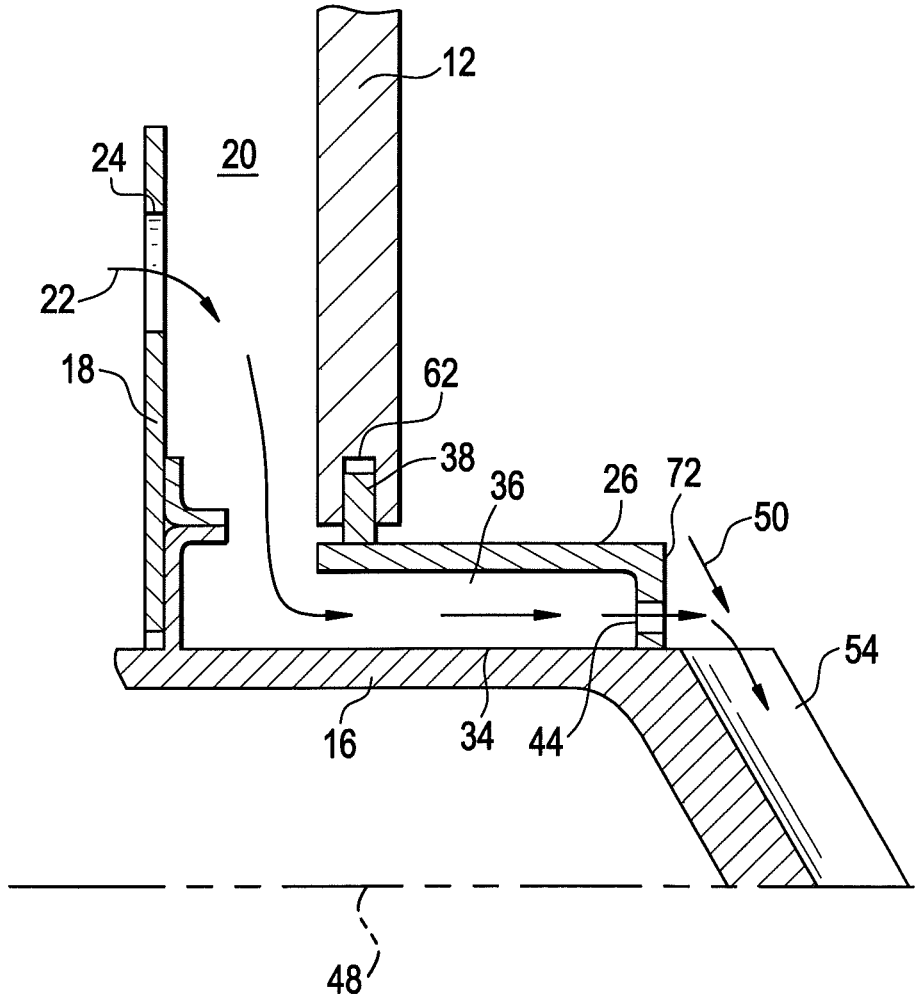
FIG. 9 is a cross-sectional view of still another embodiment of the baffle plate assembly of FIG. 2.
Figure 10:
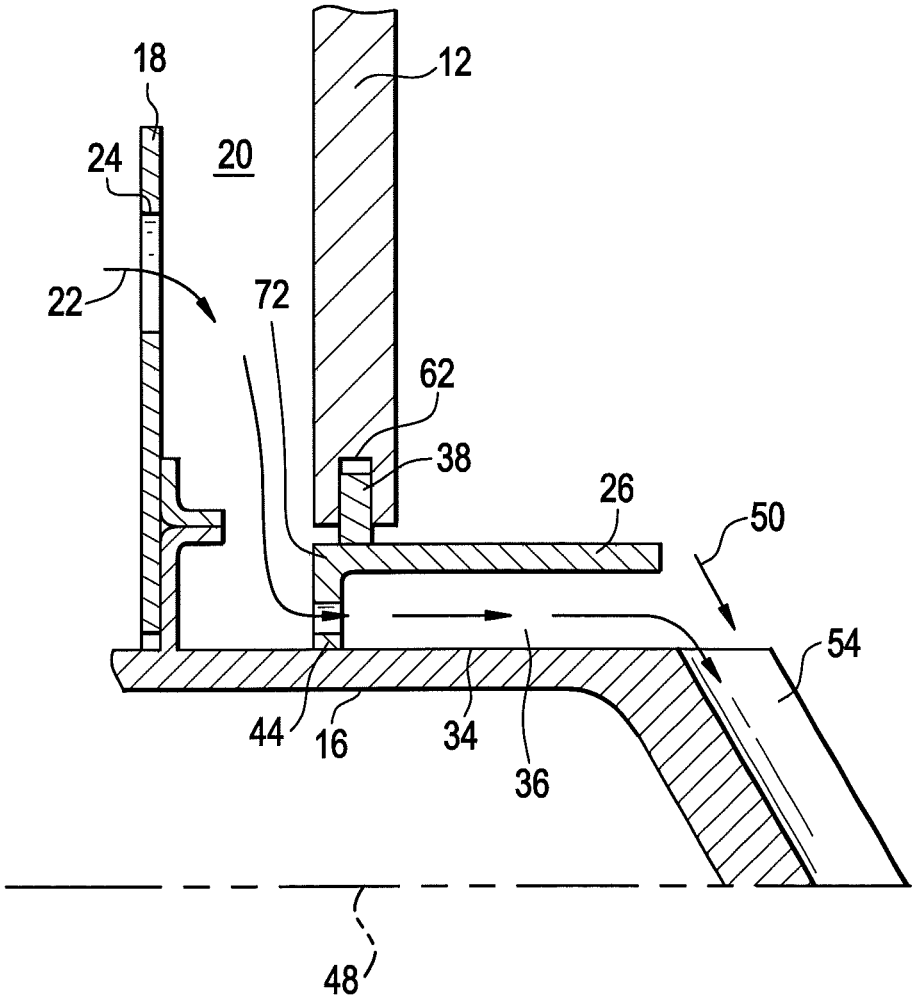
FIG. 10 is a cross-sectional view of one variation of the embodiment of baffle plate assembly of FIG. 9.

As shown in FIG. 9, in some embodiments the shroud 26 is secured to the fuel nozzle 16 by, for example, welding or brazing, and the piston rings 38 are utilized to seal between the shroud 26 and the baffle plate 12. The shroud 26 and outer surface 34 define the flow channel 36. In this embodiment, the plurality of injection holes 44 is disposed at an attachment leg 72 of the shroud 26. As shown in FIG. 9, the shroud 26 is disposed such that the attachment leg 72 is located at the plurality of airflow openings 54. In other embodiments, such as the embodiment shown in FIG. 10, the shroud 26 is reversed, so that the diluent flow 22 flows through the plurality of injection holes 44 before flowing through the flow channel 36.

Guiding the diluent flow 22 through the plurality of injection openings 44 allows injection of the diluent flow 22 nearby the air flow openings 54 to increase efficiency of the diluent flow 22. Further, the diluent flow 22 is metered via the injection openings 44 and consistent throughout the combustor 10. Thus, a volume of diluent flow 22 required is reduced thereby reducing operability issues such has dynamics and lean blow out.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor comprising:

a baffle plate including at least one through baffle hole;

a cover ring, together with the baffle plate defining a diluent plenum therebetween;

at least one fuel nozzle extending through the cover ring and the at least one through baffle hole;

a plurality of injection holes extending through the at least one fuel nozzle;

a shroud affixed to the baffle plate radially outboard of the at least one fuel nozzle, the shroud and the at least one fuel nozzle defining a flow channel therebetween, at least one seal radially between the shroud and the at least one fuel nozzle, wherein the at least one seal is configured to divert the flow of diluent into the plurality of injection holes;

a collar comprising a plurality of airflow openings, the collar located at a downstream tip of the at least one fuel nozzle and downstream of the plurality of injection holes, wherein the plurality of injection holes are configured to meter a flow of diluent from the diluent plenum into the plurality of airflow openings.

2. The combustor of claim 1 wherein the shroud is secured to the baffle plate by one or more of welding, brazing, one or more mechanical fasteners and/or adhesive.

3. The combustor of claim 1 wherein the at least one seal is at least one piston ring, and the at least one piston ring is two piston rings.

4. The combustor of claim 1 wherein the plurality of injection holes extend through a nozzle end.

5. The combustor of claim 1 wherein each injection hole of the plurality of injection holes substantially aligns circumferentially with an airflow opening of a plurality of airflow openings in the at least one fuel nozzle.

6. The combustor of claim 1 wherein the diluent is at least one of steam and/or nitrogen.

7. A method for providing diluent to a combustor comprising:

defining a diluent plenum via a baffle plate and a cover ring;

providing at least one fuel nozzle extending through a through hole in the baffle plate and through the cover ring;

providing a plurality of injection holes extending through the at least one fuel nozzle;

providing a collar comprising a plurality of airflow openings, the collar located at a downstream tip of the at least one fuel nozzle and downstream of the plurality of injection holes;

flowing the diluent from the diluent plenum through a flow channel defined between the at least one fuel nozzle and a shroud affixed to the baffle plate radially outboard of the fuel nozzle;

diverting the diluent into the plurality of injection holes via at least one seal radially between the shroud and the fuel nozzle;

flowing the diluent from the plurality of injection holes into the plurality of airflow openings.

8. The method of claim 7 wherein the at least one seal is at least one piston ring, and the at least one piston ring is two piston rings.

9. The method of claim 7 comprising mixing the at least a portion of the diluent with an airflow entering the at least one airflow opening.

10. The method of claim 7 wherein the diluent is at least one of steam and/or nitrogen.

* * * * *